US005398592A

United States Patent [19]

Turner

[11] Patent Number: 5,398,592

[45] Date of Patent: Mar. 21, 1995

[54] MODULAR PROTECTION SYSTEM

[75] Inventor: James R. Turner, Campbell, Calif.

[73] Assignee: FMC Corporation, Chicago, Ill.

[21] Appl. No.: 245,715

[22] Filed: May 18, 1994

Related U.S. Application Data

[63] Continuation of Ser. No. 945,478, Sep. 16, 1992, abandoned.

[51] Int. Cl.[6] ..... F41H 5/04; F41H 5/18

[52] U.S. Cl. ..... 89/36.08; 89/36.02; 89/36.03

[58] Field of Search ..... 89/36.01, 36.02, 36.03, 89/36.04, 36.07, 36.08, 36.11, 36.12; 109/49.5, 50, 73, 76, 79, 80, 81

[56] References Cited

U.S. PATENT DOCUMENTS

| | | | |
|---|---|---|---|
| 2,337,165 | 12/1943 | Olaszy | 89/36.02 |
| 2,376,331 | 5/1945 | Abrams | 89/36.08 |
| 2,384,594 | 9/1945 | Bierman | 109/81 |
| 2,871,763 | 2/1959 | Blomquist | 89/36.08 |
| 3,765,299 | 10/1973 | Pagano et al. | 89/36.08 |
| 4,132,446 | 1/1979 | Bauer | 89/36.08 |
| 4,391,178 | 7/1983 | Pagano | 296/104 |
| 4,398,446 | 8/1983 | Pagano et al. | 89/36.02 |
| 4,738,184 | 4/1988 | Bohne et al. | 89/36.08 |

FOREIGN PATENT DOCUMENTS

| | | | |
|---|---|---|---|
| 41271 | 12/1981 | European Pat. Off. | 89/36.02 |
| 866796 | 9/1941 | France | 89/36.02 |
| 2368007 | 5/1978 | France . | |
| 2498312 | 7/1982 | France | 89/36.08 |
| 2650387 | 2/1991 | France . | |
| 3638841 | 5/1988 | Germany . | |
| 2556722 | 7/1988 | Germany | 89/36.02 |
| 3706775 | 9/1988 | Germany . | |
| 535638 | 4/1941 | United Kingdom | 89/36.02 |
| 2219379 | 12/1989 | United Kingdom | 89/36.02 |

*Primary Examiner*—Stephen M. Johnson
*Attorney, Agent, or Firm*—Michael Lee; R. C. Kamp

[57] ABSTRACT

The invention provides modular armor for a vehicle. The modular armor comprises an outer cover with a plurality of mounting racks attached to the vehicle. Armor panels may be added to or removed from the mounting racks as needed.

4 Claims, 2 Drawing Sheets

FIG_1
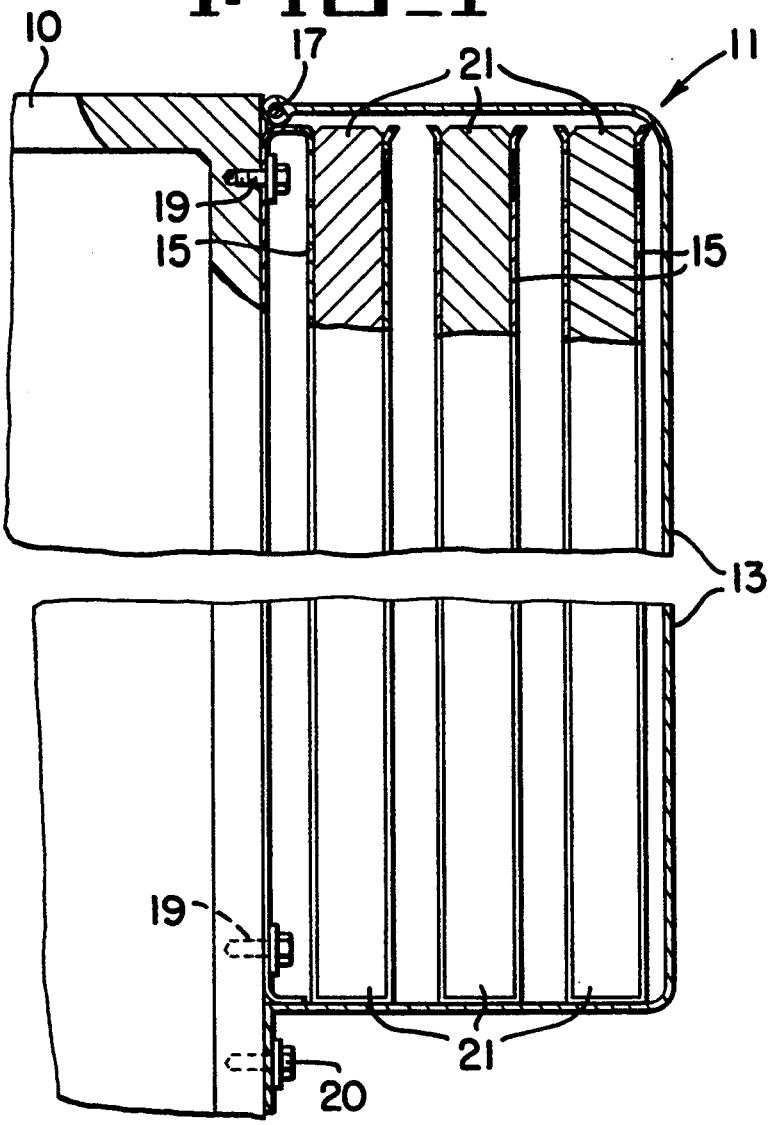
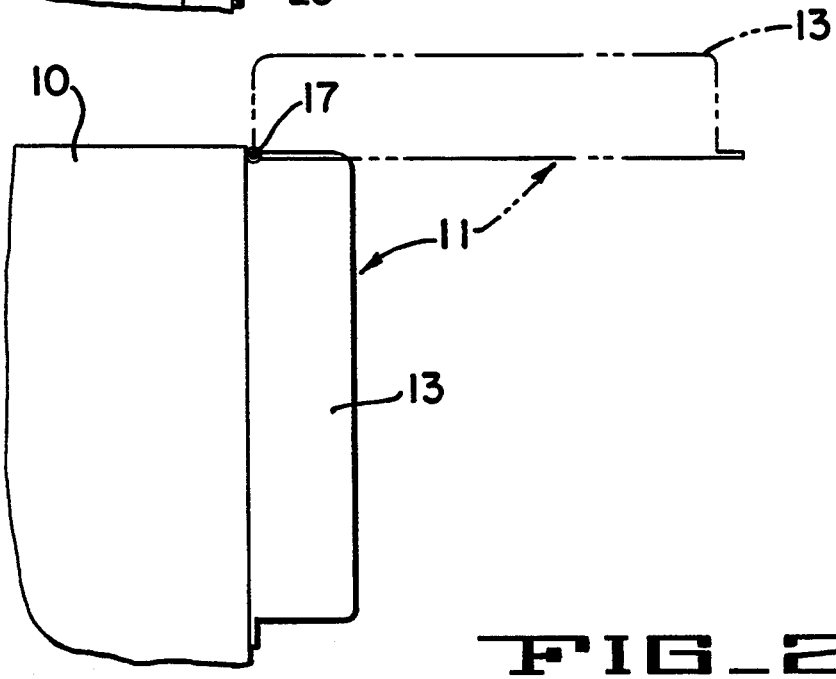
FIG_2

MODULAR PROTECTION SYSTEM

This application is a continuation of application Ser. No. 07/945,478, filed Sep. 16, 1992, now abandoned.

In providing armor to vehicles in military applications, it is desirable to have a vehicle that in some applications has enough armor to protect the vehicle from all possible threats and in other applications to have a vehicle that is lighter to provide a faster speed or longer distance range.

The invention provides a method and apparatus of providing a more heavily armored vehicles when needed and lighter vehicles when needed. In addition the invention hides the extra armor so that enemy observers do not know the what amount of armor is provided to the vehicle.

FIG. 1 is a cross sectional view of part of a hull of a vehicle, which employs the inventive modular armor.

FIG. 2 is a schematic diagram of the modular armor of FIG. 1, showing the loading position.

Figure 3:
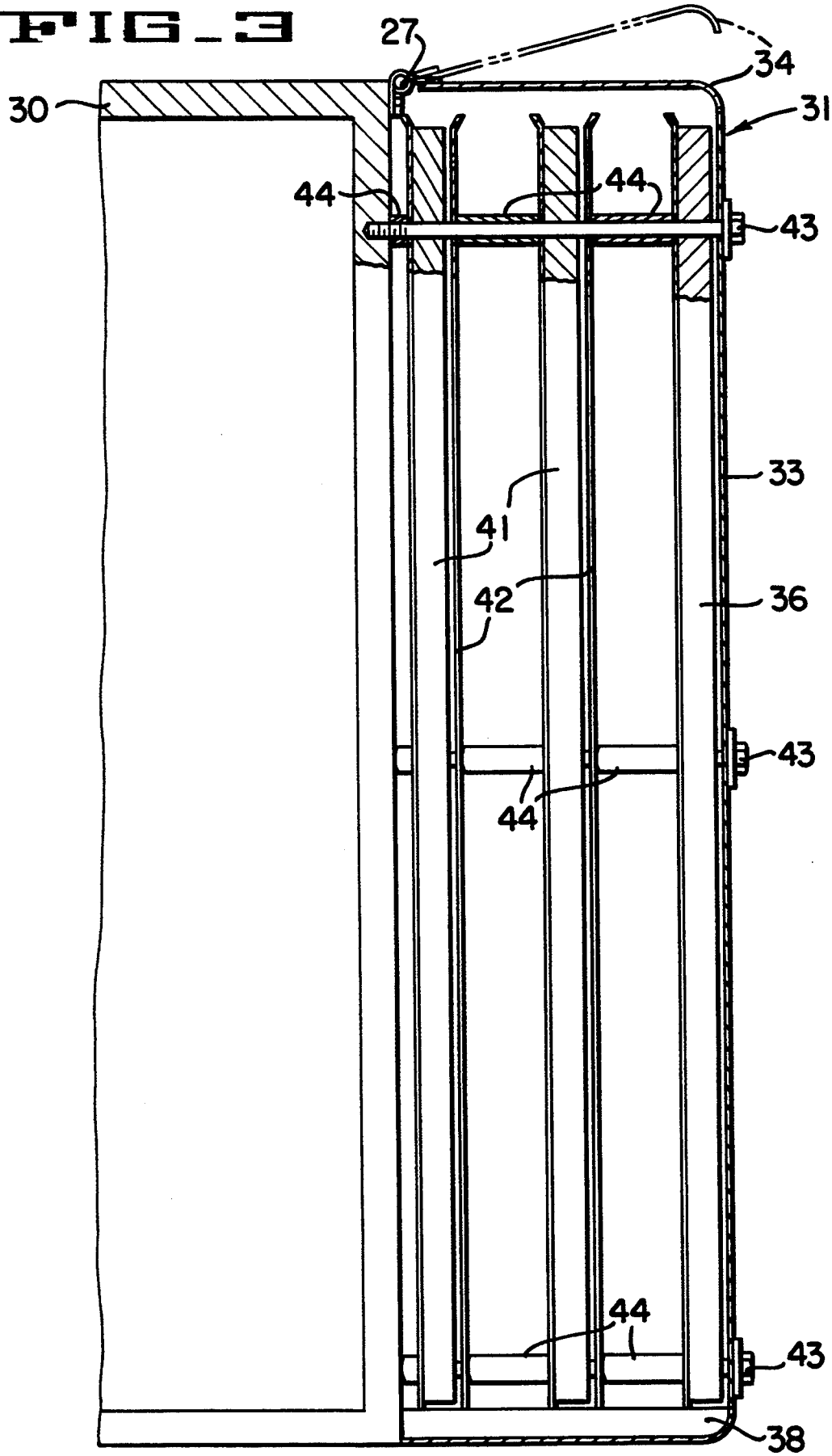
FIG. 3 is a cross sectional view of part of a hull of a vehicle, which employs another embodiment of the invention.

In FIG. 1 shows a cross sectional view of part of a hull 10 of a vehicle on which the inventive modular armor 11 is attached. The inventive modular armor 11 comprises an outer cover 13 formed by a single panel with flanges on the top and bottom of the panel, with a plurality of holding rack panels 15 placed in parallel within the outer cover 13. The cover 13 is mounted to the hull 10 by at least one hinge 17 and a mounting bolt 19. Placed within spaces between the parallel holding rack panels 15 are removable armor panels 21. A closing bolt 20 is used to keep the outer cover 13 closed In operation the closing bolt 20 may be removed to allow the outer cover 13 and the modular armor 11 to be move around the hinge 17 as shown in FIG. 2. This movement allows access to the removable armor panels 21, which may be added to increase the vehicles armor protection or removed to lighten the vehicle. The closing bolt 20 is then secured to secure the modular armor 11 in place.

In FIG. 3 another embodiment of the inventive modular armor 31 is mounted on a hull 30 of a vehicle. The modular armor 31 comprises an outer cover 33, which comprises an upper bracket 34, an outer armor panel 36 and a lower bracket 38. As illustrated in FIG. 3, two additional inner armor panels 41 are placed in holding racks 42 in the space between the hull 30 and the outer armor panel 36. A plurality of closing clamps 43 pass through the inner armor panels 41 and the outer armor panel 36 and a plurality of spacers 44 and thread into the hull 30. The spacers 44 maintain the armor panels 41 and the outer armor panel 36 in a spaced relationship. A hinge 27 mechanically connects the upper bracket 34 to the hull 30 in a manner that allows the upper bracket 34 to rotate with respect to the hull 30.

In operation the upper bracket 34 may swing upward around the hinge 27 allowing access to the armor panels 41 and the outer armor panel 36. The closing clamps 43 are removed allowing the armor panels 41 and the outer panel 38 to be removed or inserted. In the preferred embodiment the outer panel 36 is kept in place to hide from an enemy whether the armor panels 41 are absent or present, forcing the enemy to presume the presence of the armor panels 41. The clamps 43 and spacers 44 are then put in place to secure the outer armor panel 36 and the armor panels 41. The upper bracket 34 is swung downward into place.

The hinge may be replaced by other movable joints that allow access to the armor panels in other embodiments.

While a preferred embodiment of the present invention has been shown and described herein, it will be appreciated that various changes and modifications may be made therein without departing from the spirit of the invention as defined by the scope of the appended claims.

What is claimed is:

1. An apparatus for protecting vehicle hulls, wherein the apparatus is mounted to a surface of a vehicle hull, comprising:

an outer cover formed by a panel with flanges formed on edges of the panel, wherein the panel has a first side with a surface with a surface area greater than or equal to the surface area of any other side of the panel;

a movable joint joining the outer cover to the vehicle hull, wherein the joint allows at least part of the outer cover to be moved with respect to the vehicle;

a plurality of mounting means, within the outer cover; and at least one armor plate, wherein the armor plate has a first side with a surface with a surface area that is greater than or equal to the surface area of any other side of the armor plate, and wherein the armor plate is removably held in place by the plurality of mounting means, in a manner so that the surface of the first side of the armor plate is substantially parallel to the surface of the first side of the panel of the outer cover and wherein the armor plate is spaced between the panel of the outer cover and the vehicle hull.

2. The apparatus, as recited in claim 1, wherein the movable joint is a hinge.

3. The apparatus, as recited in claim 2, wherein the plurality of mounting means comprises a plurality of racks placed to form a plurality of spaces between the panel of the outer cover and the vehicle hull.

4. The apparatus, as recited in claim 3, wherein the surface of the first side of the panel of the outer cover and the surface the armor plate are substantially parallel to the surface of the vehicle hull.

* * * * *